United States Patent [19]

Hebert

[11] 4,230,412

[45] Oct. 28, 1980

[54] MATRIX PRINT HEAD ASSEMBLY

[75] Inventor: Donald G. Hebert, San Ramon, Calif.

[73] Assignee: Helmut Falk, Palo Alto, Calif.

[21] Appl. No.: 887,927

[22] Filed: Mar. 17, 1978

[51] Int. Cl.[3] ..... B41J 3/12

[52] U.S. Cl. ..... 400/124; 101/93.05

[58] Field of Search ..... 101/93.05; 400/124

[56] References Cited

U.S. PATENT DOCUMENTS

| | | | |
|---|---|---|---|
| 3,333,667 | 8/1967 | Nordin | 400/124 |
| 3,929,214 | 12/1975 | Hebert | 400/124 |
| 4,009,772 | 3/1977 | Glaser | 400/124 |
| 4,060,161 | 11/1977 | Nelson et al. | 400/124 |

*Primary Examiner*—Paul T. Sewell

*Attorney, Agent, or Firm*—Bruce G. Klaas; Richard D. Law; Dennis K. Shelton

[57] ABSTRACT

A wire matrix print head assembly having a plurality of circumferentially spaced armature members in which each armature member is operatively associated with a pair of radially spaced magnetic pole members and a coil associated therewith, each armature member being mounted between the pole members and the wire printing members with the end surfaces of the pole members facing the direction of movement of the armatures during printing movement from a non-print position to a print position, the inner pole member end surface providing a pivotal support surface for the armature member and also providing a locating surface engageable with a portion of the armature housing opposite thereto, a resilient biasing member mounted on the armature housing portion and engaging the armature member opposite the pivotal support surface, a resilient support and locating member engaging the radially innermost end portion of the armature opposite the associated wire printing member, and an axially adjustable sleeve means for supporting and locating the resilient support and locating member.

19 Claims, 5 Drawing Figures

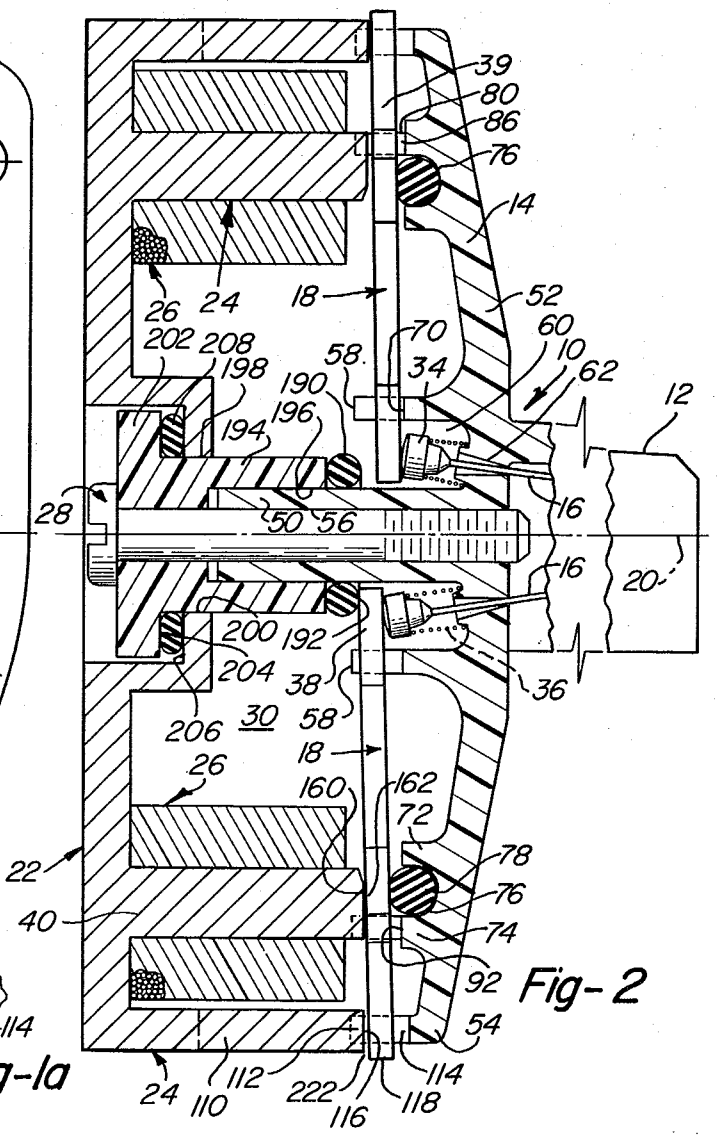
Fig-2
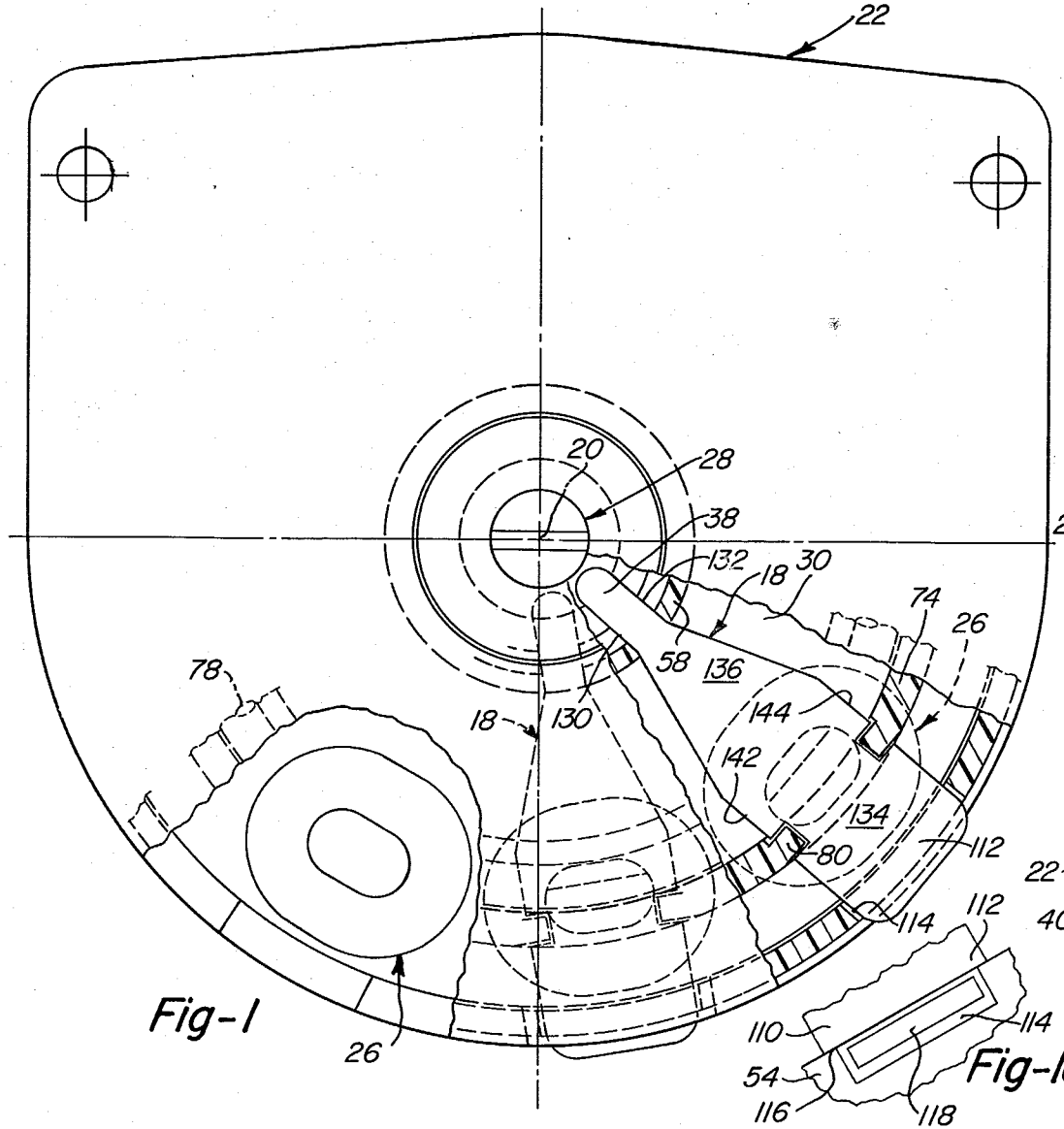
Fig-1
Fig-1a

MATRIX PRINT HEAD ASSEMBLY

BACKGROUND AND SUMMARY OF THE INVENTION

This invention relates to wire matrix point head apparatus of the general type disclosed in prior U.S. Pat. Nos. 3,929,214 and 3,994,381.

In general, this invention comprises an improvement in a wire matrix print head assembly and apparatus disclosed in my co-pending U.S. application Ser. No. 809,423, filed June 23, 1977, the disclosure of which is hereby incorporated herein by reference.

In prior art apparatus, such as that disclosed in the afore-identified United States patents and application, wire type printing members (stylus or styli) are arranged in spaced relationship about a central longitudinal axis in a generally circular or elliptical matrix for reciprocable movement between a non-print position and a print position with the movement from the non-print position to the print position being of ballistic nature, i.e. by impact and/or driving engagement with another moving member. Each printing member is operatively associated with a radially innermost portion of a radially outwardly extending armature member and ballistically driven thereby by impact therewith during pivotal movement of the armature from a non-print position to a print position. A radially outermost portion of each armature is operatively associated with a radially outwardly located and circumferentially spaced electromagnetic means having radially spaced pole portions including a radially innermost pole portion and a radially outermost pole portion, the pole portions including flat coplanar radially spaced and radially extending end surfaces which face away from the direction of movement from the non-print position to the print position and engaging a hole surface of the armature at various times. In prior art apparatus, the construction and arrangement has been such that the armature was pivotally supported at all times on a radially outermost edge of the end surface of the radially outermost pole portion and impacted the end surface of the radially innermost pole portion which was constructed and arranged to cause pivotal movement of the armature from the non-print position to the print position by magnetic attraction. In addition, the construction and arrangement was such that the armature impacted on the end surface of the innermost pole portion at approximately the same time that the printing member is being driven through the paper. The result was that the kinetic energy of the armature was lost and only the kinetic energy of the printing member was thereafter effective to cause completion of the printing operation. In fact, of the kinetic energy available just prior to impact of the armature with the surface of the pole portion, approximately two-thirds was lost through armature impact with only approximately one-third remaining in the printing member to accomplish the printing operation. The lost two-thirds of the available kinetic energy was simply dissipated upon impact with the surface of the pole portion with resultant high levels of noise and heat. In addition, the speed of the printing process was reduced and the number of sheets of paper which could be printed at one time was also limited. Furthermore, in order to obtain sufficiently high levels of kinetic energy to produce satisfactory printing results, relatively high levels of energy were required to operate the electromagnetic means.

In the invention of my prior application, the armature members and the electromagnetic means were constructed and arranged so that the armature members were normally pivotally supported by a first pivot means on a radially innermost edge of a radially innermost pole portion while being magnetically attracted by a radially outermost pole portion. In addition, the pole portions were constructed and arranged so that the end surfaces thereof faced toward the direction of movement of the armature and the printing members from the non-print position to the print position. As a result, the driving movement of the armature continued after impact with the end surface of the outermost pole portion without loss of a substantial portion of the kinetic energy thereof as in prior art apparatus. Furthermore, the construction and arrangement was such that after impact of the armature with the end surface of the outermost pole portion, the first pivot means was disengaged and a second pivotal means was provided between a radially outermost portion of the armature and the radially outermost edge of the radially outermost pole portion whereby the driving movement of the armature could continue substantially unimpeded until completion of the printing operation. The prior invention further provided for new and improved mounting of the apparatus including the use of housing means made of one piece of molded plastic material which mounted and supported all of the apparatus in a new and improved manner. The electromagnetic means comprised a one piece member of sintered powder metallic material providing an end plate having the pole portions integral therewith. Also, the one piece electromagnet member was mounted on the one piece housing means in a manner requiring only one threaded fastening means which could be readily adjusted to vary the axial air gap between the end surfaces of the pole portions and the armature as well as adjusting the armature movement.

The present invention involves improvements in the manner of mounting and supporting the armature members. In general, the invention comprises a construction and arrangement wherein radially intermediate portions of the armature members are pivotally supported on the radially innermost magnetic pole portions with a resilient O-ring member located opposite thereto and continuously engaging each armature member. Each of the radially innermost pole portions are positively uniformly located and positioned relative to the O-ring member by abutting engagement with the portion of the armature housing supporting the O-ring member. The radially innermost portions of the armature members are engageable with an adjacent continuous annular side surface of a resilient locating ring member in the non-print position. Adjustment and locating means are provided to uniformly axially adjust the location and position of the resilient locating ring member relative to the innermost portions of the armature members to thereby uniformly axially adjust the location and position of each armature member relative to the wire print members, which are driven by the radially innermost end portions of the armature members, and also the location and position of the armature members relative to the inner pole portions.

BRIEF DESCRIPTION OF THE DRAWING

The foregoing objectives and advantages are obtained in illustrative and presently preferred embodiments of the invention shown on the accompanying drawing in which:

FIG. 1 is an end view, partially in cross-section, of an illustrative embodiment of a matrix print head assembly;

FIG. 1*a* is a partial end view of a portion of the apparatus of FIG. 1;

FIG. 2 is a partial side elevational view in cross-section of the assembly of FIG. 1;

DETAILED DESCRIPTION

Figure 3:
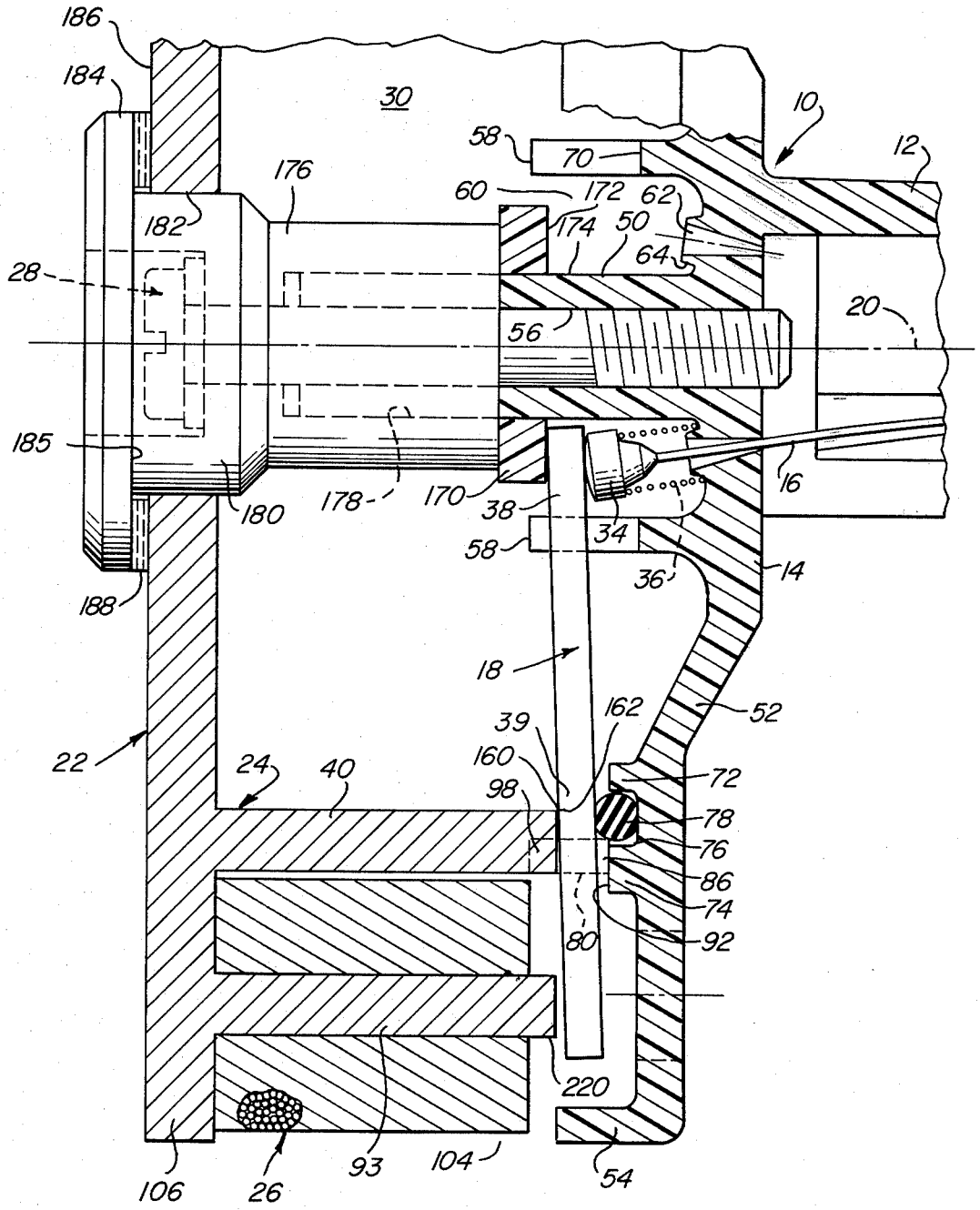
FIG. 3 is a partial side elevational view in cross-section of a presently preferred embodiment of a matrix print head assembly.

In general, the print head apparatus comprises a housing means member 10 having an elongated wire stylus guide and support portion 12 and an annular armature housing portion 14 for supporting a plurality of elongated wire stylus print members 16 and an equal number of armature members 18 mounted in equal radially and circumferentially spaced relationship about a central longitudinal axis 20. The print head apparatus further comprises electromagnetic means comprising magnetic metallic plate means 22 for supporting an equal number of armature actuating magnetic pole means 24 and electrical wire coil means 26 located in equally radially and circumferentially spaced relationship about central axis 20 in juxtaposition to and operative relationship with the armature members 18. The magnetic plate means 22, which may have a generally elliptical peripheral configuration to provide mounting means for attachment to a printer apparatus (not shown), is secured to the housing means 10 by a fastening means 28 to define an annular chamber 30 in which are mounted the armature members 18, the magnetic pole means 24, and the coil means 26.

In the illustrative embodiment, there are nine wire styli print members 16 of conventional design each including a paper impacting end portion (not shown) and an impact head portion 34. The wire members 16 are slidably reciprocably movable between a retracted non-print position, lower armature of FIGS. 1 and 3, and an extended print position, upper armature of FIG. 22. The wire members are normally located in the non-print position by associated spring members 36 and are movable to the print position by kinetic energy obtained from associated armature members 18. There are nine armature members 18, each including a radially innermost drive head portion 38 mounted in abutting engagement with the impact head portion 34 of the associated wire member 16. An intermediate portion 39 of each armature member is pivotally supported by the radially innermost pole portion 40 and mounted between the associated magnetic pole means 24 and the housing means portion 14 so as to cause pivotal movement of the drive head portion 38 between the rearwardly retracted non-print position, and the forwardly extended print position relative to the wire members 16.

The Housing Means

Referring to FIGS. 1 and 3, the housing means 10 is preferably made of one piece of rigid molded plastic material such as glass reinforced temperature resistant Nylon. The housing portion 14 comprises a central axially extending elongated annular hub portion 50, a radially extending annular flange portion 52 and an axially extending annular outer rim portion 54. The hub portion has a central annular bore 56 for receiving fastening means 28 which may be in the form of a self-threading self-locking screw member or the bore 56 may be threaded.

A radially innermost annular axially extending first inner rim portion 58 is radially outwardly spaced from hub portion 50 to provide an annular cavity 60 therebetween in which are mounted the drive end portions 38 of the wire members 16 and spring members 36. An equal number of circumferentially spaced tapered wire guide bores 62 are provided in flange portion 52 and extend into cavity 60 through annular spring mounting hub portions 64. The compression spring member 36 is mounted circumjacent the drive end portions of the wire members and hub portions 64 with one end of the spring member abutting a side wall surface of flange portion 52 and the other end abutting a side wall surface of a conventional plastic percussion cap member 34 mounted on the end of the wire member in a conventional manner. Thus, compression spring members 36 provide spring means for biasing the wire members 16 and the armature members toward the retracted non-print position.

Figure 4:
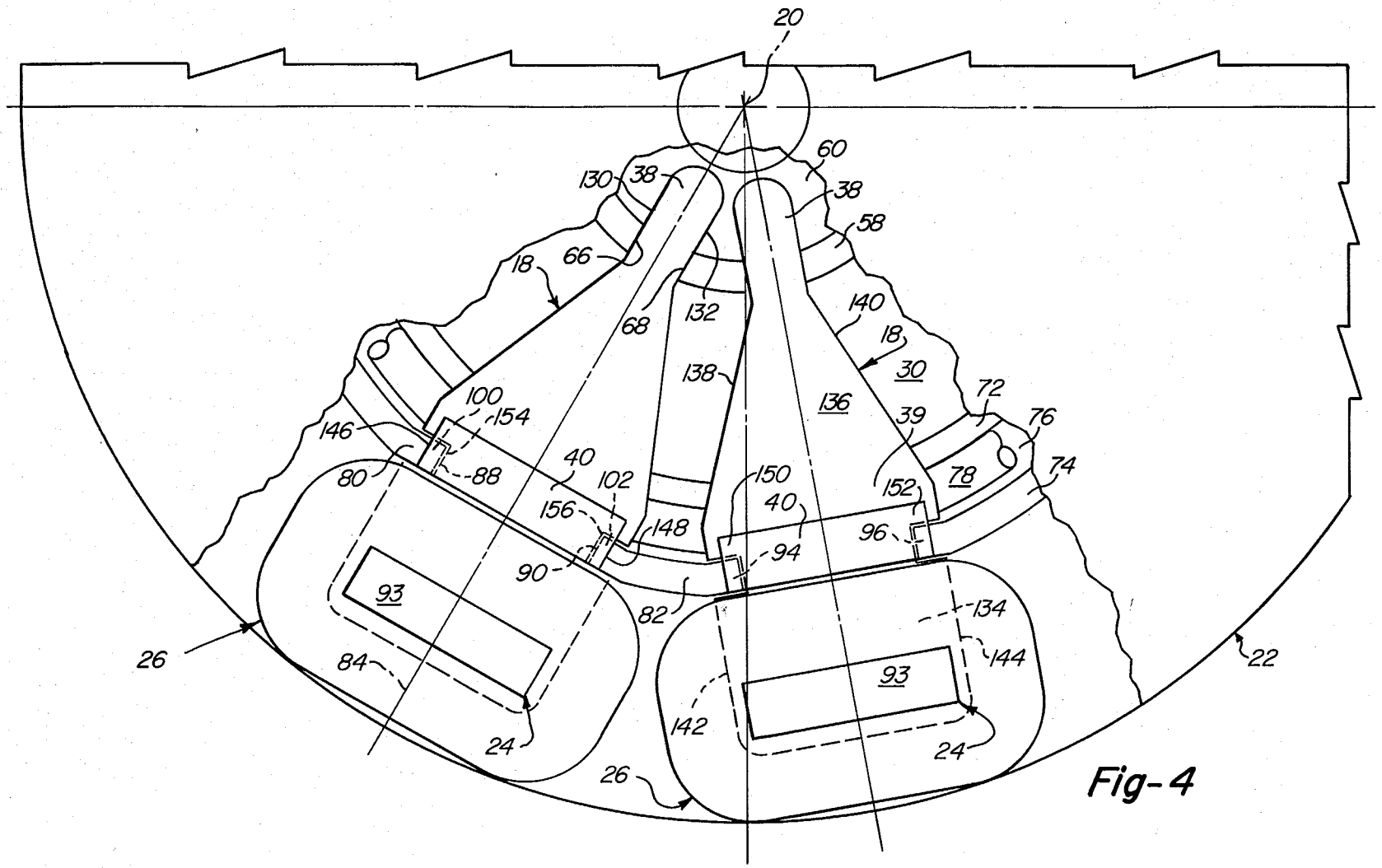
FIG. 4 is a partial end view, partially in cross-section, of the apparatus of FIG. 3.

The rim portion 58 includes spaced parallel axially extending flat guide surfaces 66, 68, in FIG. 4, connected by a radially extending annular end surface 70, FIG. 2, to provide radially innermost armature mounting slot means circumferentially spaced thereabout for guiding and supporting the armature members during movement between the non-print and the print position.

In both embodiments of the invention, a radially intermediate annular axially inwardly extending second inner rim portion 72 is radially outwardly spaced from rim portion 58 and located in juxtaposition to another radially intermediate generally annular axially inwardly extending third rim portion 74 to provide an annular O-ring groove 76 therebetween in which is mounted a resilient compressible O-ring member 78 for continuously engaging the intermediate portion 39 of armatures 18. As shown in FIG. 4, the rim portion 74 has a generally polygonal peripheral configuration comprising nine relatively long length circumferentially spaced straight sided rim portions 80 connected by relatively short length connecting rim portions 82. Each rim portion 80 is centered on and extends transversely relative to the associated one of radial lines 84. Each rim portion 80 provides a radially outermost second armature guide and support means located opposite the innermost pole portion 40 in the form of a slot 86, FIG. 3, defined by spaced parallel flat side surfaces 88, 90, FIG. 4, extending parallel to the associated one of the radial lines 84 and a flat bottom surface 92, FIGS. 2 and 3.

In the presently preferred embodiment, FIGS. 3 and 4, wherein the coil 26 is associated with the radially outermost pole portion 93, offset notches 94, 96, FIG. 4, are provided in rim portion 80 adjacent surfaces 88, 90 to receive the outer end portion 98, FIG. 3, of the innermost pole portion 40 and provide flat parallel abutment and locating surfaces 100, 102, FIG. 4, therefor. In addition, an axially outermost circumferentially extending slot 104, FIG. 3, is provided between the outer rim portion 54 and the peripheral outer portion 106 of the magnetic plate member 22 to provide for full and complete access to the radially outermost ends of the armatures and for more adequate cooling of the magnetic means.

In the illustrative embodiment of FIGS. 1, 1*a* and 2, wherein the coil 26 is associated with the radially innermost pole portion 40, the radially outermost pole portions 110 are provided by circumferentially spaced axially extending flange portions of plate member 22 having circumferentially spaced end portions 112 located opposite corresponding circumferentially spaced slots 114 in the axially circumferentially extending outer rim portion 54 of housing 10 and in axially locating abutment with radially and circumferentially extending side surface portions 116 of rim portion 54 with the radially outermost end portions 118 of the armature members extending radially outwardly through the slots 114 as shown in FIG. 1*a*.

The Electro-Magnetic Means

The plate means 22 and the pole means 24 of both embodiments are preferably made of one piece of sintered powder magnetic material. The pair of spaced parallel radially innermost and outermost pole portions 40, 93, 110 are of rectangular cross-section, as shown in FIG. 4, and integrally connected to the plate portion or separately attached thereto in any conventional manner. The coil member 26 is mounted on the associated pole portion 40 or 93 in axially spaced relationship to the axially outermost surfaces of the pole portions.

The Armatures

Each armature member 18 of each embodiment comprises one piece of relatively thin rigid magnetic sheet metal material having a relatively narrow width radially innermost drive head portion 38 with relatively closely spaced parallel side wall portions 130, 132 extending parallel to the radial lines 84. The spacing of side wall portions 130, 132 is slightly less than the spacing of side surfaces 66, 68 of guide slot means 86 so as to enable free sliding relative movement therebetween. A relatively wide radially outermost portion 134 is connected to portion 38 by an intermediate connecting portion 136 having inclined side wall portions 138, 140. Outermost portion 134 has relatively widely spaced parallel side wall portions 142, 144 extending parallel to radial line 84. The spacing of side wall portions 142, 144 is sufficiently greater than the spacing of the adjacent side surfaces 146, 148 of the associated pole portions so as to provide a substantial surface overlap at 150, 152. A pair of aligned slots 154, 156, FIG. 4, are provided along side wall portions 142, 144 of armature 18 and have a rectangular configuration such as to loosely receive the adjacent wall portions of rim portion 80 with the side surfaces 157, 158, 159, FIG. 1, of the slots 154, 156 having a spacing slightly greater than the spacing of adjacent side surfaces of guide slot means 86 so as to be received thereabout for free sliding movement relative thereto.

The arrangement of both embodiments is such that in the assembled position, each armature 18 is loosely movably mounted in and laterally confined by the slot means 70 and 86 with the compression springs 36 and the O-ring member 78 cooperating to locate the armature members 18 in the non-print position whereat an intermediate portion of the side surfaces 160 of the armatures are pivotally supported by the radially innermost edge surfaces 162 of the radially innermost pole portions 40 as shown in FIGS. 2 and 3.

The Inner Armature Support and Adjustment Means

A radially innermost resilient annular armature support and adjustment means is provided in each embodiment for resiliently adjustably supporting the radially innermost end portion of each armature member. In the preferred embodiment of FIGS. 3 and 4, a resilient annular member 170 having a flat annular armature abutment surface 172 is axially slidably mounted on the cylindrical outer peripheral surface 174 of hub portion 50. An elongated adjustment and abutment hub member 176 has a bore portion 178 axially slidably adjustably supported on the outer periphery 174 of hub portion 50. An enlarged support head portion 180 is axially adjustably slidably supported in a support bore 182 in plate member 22. An enlarged abutment head portion 184 has an abutment surface 185 extending parallel to side surface 186 of plate member 22 with a resilient washer member 188 compressibly mounted therebetween.

In the illustrative embodiment of FIGS. 1 and 2, a resilient O-ring member 190 having an annular armature abutment surface 192 is axially slidably mounted on the outer peripheral surface of hub portion 50. An elongated adjustment and abutment hub member 194 has a counter bore portion 196 axially slidably adjustably supported on the outer periphery of hub portion 50 and an outer peripheral portion 198 axially slidably adjustably supported in a bore portion 200 of plate member 22. An enlarged abutment head portion 202 has an abutment surface 204 extending parallel to plate member surface 206 with a resilient O-ring member 208 compressibly mounted therebetween.

In Operation

In the non-print position of FIG. 4, a radially innermost portion of the armatures of maximum radial length extends radially inwardly beyond a first pivot means 162 provided by the edge surfaces of the radially innermost pole portion 40 and a radially outermost portion of the armatures of minimum radial length extends radially outwardly beyond the first pivot means.

The axial location of the magnetic member 22 and the pole portions thereof are very accurately located relative to the housing flange portion 52 by abutment of pole end surfaces 150, 152 with rim surfaces 100, 102, FIGS. 3 and 4, or pole end surfaces 112 with flange surfaces 116. Thus, each of the intermediate portions of the armature members are very accurately positioned relative to the O-ring member 78 which is itself very accurately positioned by the side surfaces of annular slot 76. In addition, the axial location of the radially innermost end portions 38 of each armature member are adjustably very accurately uniformly controlled by engagement with the side surface of resilient members 170 or 190. The adjustment hub members 176 and 198 are resiliently axially floatably adjustably mounted between the resilient members 170, 188 and 190, 208.

When the coil members 26 are energized, the magnetic force is effective on the minimum radial length radially outermost portions of the armatures to move those portions toward the pole portion end surfaces by pivotal movement about pivotal surfaces 162. When the side surfaces 160 of the armatures become parallel with the end surfaces of the pole portions, the first pivot means provided by edge surface 162 becomes inoperative and a second pivot means provided by the radially outermost edge surfaces 220, FIG. 3, or 222, FIG. 2, of the outer pole portions becomes operative to sustain further pivotal movement of the armatures while at the same time increasing the radial length from the effective pivot means to the drive head portions 38 as disclosed in my prior application. The O-ring member 78 is resiliently compressed during the pivotal movement from the non-print position to the print position which results in increased frequency response with some loss of kinetic energy of the armatures. When the coil members have been de-energized, the compression springs 36 associated with the wire members 16, the rebound force of the sheets of paper impacted by the wire members, and the compressive force in the O-ring member 78 combine to rapidly return the armature members to the non-print position while at the same time enabling the compression springs 36 and the residual rebound paper force to equally rapidly return the wire members 16 to the non-print position. Any overtravel of the armatures during the return movement is limited by resilient compressible engagement with the members 170 or 190 to virtually eliminate rebound and noise in operation. It is to be noted that arrangement is such that the return movement is substantially without resistance until the return movement is substantially completed. It is also to be noted that the arrangement is such that at the time of impact of the wire members 16 with the paper, the outermost pivot means 220 or 222 has been established so that maximum leverage is utilized both during printing and during the initial part of the return movement. The single center connection provided by the threaded fastening means 28 between two relatively rigid accurately located parts in combination with the resilient member enables very fine accurate adjustment of the air gap between the armature members and the pole portions.

It is contemplated that the illustrative and presently preferred embodiments of the invention may be variously modified and otherwise constructed, and it is intended that the following claims be construed to include alternative embodiments except insofar as limited by the prior art.

What is claimed is:

1. A matrix print head assembly comprising:

a number of wire members spaced about a central longitudinal axis and being longitudinally movable between a non-print position and a print position;

guide means for movably supporting said wire members;

a number of rigid armature members equal to the number of wire members movable between a non-print position and a print position and extending radially outwardly of and being circumferentially spaced about the central longitudinal axis with radially inner drive head portions engageable with said wire members during movement from the non-print position to the print position to drive the wire members from the non-print position to the print position;

a number of electromagnet means, having radially innermost and radially outermost pole portions, equal to the number of armature members, mounted in juxtaposition to a radially outer portion of said armature members for pivotally supporting said armature members during movement from the non-print position to the print position and being selectively energizable for causing pivotal movement of said armature members toward said electromagnet means and opposite pivotal movement of the radially inner portion of said armature members away from said electromagnet means during movement from the non-print position to the print position by magnetic force applied to the radially outer portion;

said armature members being positioned between said electromagnet means and said wire members such that said drive head portions are movable away from said electromagnetic means toward said wire members during movement from the non-print position to the print position;

pivotal support means on the radially innermost pole portions for pivotally supporting an intermediate portion of said armature members during movement of said armature members from the non-print position to the print position; and resilient axially adjustable abutment means engageable with radially innermost portions of each armature member.

2. The invention as defined in claim 1 and further comprising:

a resilient compressible support means for engaging said armature members opposite said pivotal support means and for applying a force to said armature members opposite to the direction of movement of said armature members from the non-print position to the print position.

3. The invention as defined in claim 2 and wherein:

said resilient compressible support means comprising an O-ring member having circumferentially spaced portions in constant engagement with said armature members.

4. The invention as defined in claim 3 and further comprising:

a molded plastic housing means for supporting said wire members and said armature members and said electromagnetic means;

said housing means comprising a flange portion and a rim portion defining a cavity containing said armature members and said electromagnetic means;

said armature members extending generally parallel to said flange portion and being located in juxtaposition thereto;

said electromagnetic means extending generally parallel to said rim portion and being located in juxtaposition thereto; and slot means being integrally formed on said flange portion for receiving and confining said O-ring member.

5. The invention as defined in claim 4 and wherein said electromagnetic means comprising:

an electrically conductive rigid metallic plate member extending parallel to said flange portion;

fastening means for connecting said plate member to said housing means;

a number of pairs of magnetic pole portions equal in number to said armature members mounted on said magnetic plate member and extending into said cavity;

an electrical coil member associated with each of said pairs of magnetic pole portions within said cavity; and abutment and locating means on said pole portions for engagement with portions of said flange portion to axially locate said electromagnetic means relative to said housing means.

6. The invention as defined in claim 5 and wherein:

said fastening means being adjustably resiliently connected to said housing means for varying the location of said flange portion relative to said electromagnetic means.

7. The invention as defined in claim 6 and further comprising:

a resilient compressible member mounted between and compressibly engageable by said plate member and said fastening means for resiliently compressibly supporting said housing means relative to said plate member.

8. The invention as defined in claim 7 and further comprising:

hub means mounted between said electromagnetic means and housing means for variable axial adjustment relative thereto.

9. The invention as defined in claim 8 and wherein:

one of said hub means being in abutting locating engagement with said resilient axially adjustable abutment means.

10. The invention as defined in claim 9 and wherein:

the other end of said hub means being in abutting locating engagement with said resilient compressible member mounted between said plate member and said fastening means.

11. A matrix print head assembly comprising:

a number of wire members spaced about a central longitudinal axis and being longitudinally movable between a non-print position and a print position;

guide means for movably supporting said wire members;

a number of rigid armature members equal to the number of wire members movable between a non-print position and a print position and extending radially outwardly of and being circumferentially spaced about the central longitudinal axis with radially inner drive head portions engageable with said wire members during movement from the non-print position to the print position to drive the wire members from the non-print position to the print position;

a number of electromagnet means, having radially innermost and radially outermost pole portions, equal to the number of armature members, mounted in juxtaposition to a radially outer portion of said armature members for pivotally supporting said armature members during movement from the non-print position to the print position and being selectively energizable for causing pivotal movement of said armature members toward said electromagnet means and opposite pivotal movement of the radially inner portion of said armature members away from said electromagnetic means during movement from the non-print position to the print position by magnetic force applied to the radially outer portion;

pivotal support means on one of said pole portions for pivotally supporting an intermediate portion of said armature members during movement of said armature members from the non-print position to the print position;

a molded plastic housing means for supporting said wire members;

a radially outwardly extending molded plastic armature retaining flange means having a radially outermost rim portion axially spaced from said electromagnetic means and defining a cavity containing said armature members;

said armature members extending generally parallel to said flange portion and being located in juxtaposition thereto;

an electrically conductive rigid metallic plate member extending radially outwardly of the central longitudinal axis generally parallel to said armature retaining flange means;

fastening means for connecting said plate member to said housing means and said armature retaining flange means;

a number of pairs of magnetic pole portions equal in number of said armature members mounted on said plate member and extending into said cavity;

an electrical coil member associated with one of each of said pairs of magnetic pole portions within said cavity; and abutment and locating means on said pole portions for fixed rigid abutting engagement with portions of said armature retaining flange means to fixedly axially locate a radially outer portion of said armature retaining flange means relative to said plate member.

12. The invention as defined in claim 11 and further comprising:

adjustment means connecting said plate member and said flange means for adjustably resiliently varying the location of said armature members relative to said electromagnetic means.

13. The invention as defined in claim 12 and further comprising:

resilient compressible support means for engaging said armature members opposite said pivotal support means and holding said armature members on said pivotal support means during movement of said armature members between the non-print position and the print position.

14. The invention as defined in claim 13 and wherein:

said resilient compressible support means comprising an O-ring member having circumferentially spaced portions in constant engagement with said armature members.

15. The invention as defined in claim 11 and further comprising:

circumferentially spaced slot means in said flange means axially opposite one of the pole portions for receiving and confining portions of each of said armature members; and circumferentially spaced axially facing abutment surface means on said flange means adjacent each of said slot means in rigid abutting engagement with the one of said pole portions for fixedly locating said flange means relative to said electromagnetic means.

16. The invention as defined in claim 15 and wherein each of said abutment surface means comprising a pair of circumferentially spaced coplanar abutment surfaces in abutting engagement with an axially facing outer end surface of the one of said pole portions.

17. The invention as defined in claim 16 and wherein:

said slot means being located axially opposite said radially innermost pole portion; and said abutment surface means engaging the outer end surface of said radially innermost pole portion.

18. The invention as defined in claim 16 and wherein:

said slot means being located adjacent said rim portion axially opposite said radially outermost pole portion and said abutment surface means engaging the outer end surface of said radially outermost pole portion.

19. The invention as defined in claim 5 or 18 and wherein:

said electrical coil member being mounted on said radially outermost pole portion.

* * * * *

UNITED STATES PATENT AND TRADEMARK OFFICE

CERTIFICATE OF CORRECTION

PATENT NO. : 4,230,412

DATED : October 28, 1980

INVENTOR(S) : Donald G. Hebert

It is certified that error appears in the above-identified patent and that said Letters Patent are hereby corrected as shown below:

On the cover page. column 1, "Assignee: Helmut Falk, Palo Alto, Calif." should read -- Assignee: Helmut Falk, Palo Alto; Donald G. Hebert San Ramon, both of Calif. , part interest --.

Signed and Sealed this

*Fourth* Day of *August 1981*

[SEAL]

*Attest:*

GERALD J. MOSSINGHOFF

*Attesting Officer*

*Commissioner of Patents and Trademarks*